US007578154B2

(12) United States Patent
Beresnitzky

(10) Patent No.: US 7,578,154 B2
(45) Date of Patent: Aug. 25, 2009

(54) KEY CASE WITH KEY SELECT MECHANISM

(76) Inventor: Bernardo Beresnitzky, 170 - 53rd St., Brooklyn, NY (US) 11232

( * ) Notice: Subject to any disclaimer, the term of this patent is extended or adjusted under 35 U.S.C. 154(b) by 47 days.

(21) Appl. No.: 11/787,823

(22) Filed: Apr. 17, 2007

(65) Prior Publication Data

US 2008/0196462 A1 Aug. 21, 2008

Related U.S. Application Data

(60) Provisional application No. 60/902,704, filed on Feb. 21, 2007.

(51) Int. Cl.
*A44B 15/00* (2006.01)

(52) U.S. Cl. ..... 70/459; 70/456 R; 70/456 B

(58) Field of Classification Search ..... 70/456 R, 70/456 B, 459
See application file for complete search history.

(56) References Cited

U.S. PATENT DOCUMENTS

| | | | | | |
|---|---|---|---|---|---|
| 1,885,957 | A * | 11/1932 | Singleton | 70/456 R |
| 1,998,799 | A * | 4/1935 | Woina et al. | 70/456 R |
| 2,690,666 | A * | 10/1954 | Morris et al. | 70/456 R |
| 3,004,422 | A * | 10/1961 | Starrett | 70/456 R |
| 3,173,280 | A * | 3/1965 | Oberacker | 70/456 R |
| 3,321,943 | A * | 5/1967 | Reyes | 70/456 R |
| 3,696,649 | A * | 10/1972 | Chow et al. | 70/456 R |
| 3,745,799 | A * | 7/1973 | Fagiano | 70/456 R |
| 4,569,215 | A * | 2/1986 | McCarthy | 70/456 R |
| 4,706,803 | A * | 11/1987 | Wang | 206/37.1 |
| 5,117,666 | A * | 6/1992 | Keefer | 70/456 R |
| 5,215,190 | A * | 6/1993 | Hoffpauir, Jr. | 206/37.2 |
| 5,355,702 | A * | 10/1994 | Escribens | 70/395 |
| 5,495,942 | A * | 3/1996 | Izhak | 206/372 |
| 5,943,889 | A * | 8/1999 | Chiu | 70/456 R |
| 6,691,539 | B2 * | 2/2004 | Jacob et al. | 70/408 |
| 6,705,141 | B1 * | 3/2004 | Müller et al. | 70/408 |
| 6,892,558 | B2 * | 5/2005 | Chodosh | 70/456 R |
| 7,032,419 | B2 * | 4/2006 | Booker | 70/456 R |
| 7,055,352 | B2 * | 6/2006 | Meyerson et al. | 70/456 R |
| 7,127,922 | B2 * | 10/2006 | Khounsombath et al. | 70/456 R |
| 7,370,501 | B2 * | 5/2008 | Miyata et al. | 70/395 |
| 2001/0002544 | A1 * | 6/2001 | Schwab | 70/456 R |
| 2005/0103070 | A1 * | 5/2005 | Meyerson et al. | 70/456 R |
| 2005/0204789 | A1 * | 9/2005 | Brion Camean et al. | 70/456 R |
| 2006/0144106 | A1 * | 7/2006 | Beresnitzky | 70/456 R |
| 2007/0074551 | A1 * | 4/2007 | Garcia | 70/456 R |
| 2008/0006070 | A1 * | 1/2008 | Aizpurua | 70/456 R |
| 2008/0072638 | A1 * | 3/2008 | Rooker | 70/456 R |

* cited by examiner

*Primary Examiner*—Suzanne D Barrett
(74) *Attorney, Agent, or Firm*—Bernard Malina; Malina & Associates PLLC

(57) ABSTRACT

A key case includes a housing within which there is a plurality of rotationally mounted key holders. Each key holder is connected to an individual key. A plurality of buttons is mounted on the housing. Pressing on a selected button enables a desired key to swing out of the housing and move into an outwardly projecting position wherein it can be used to unlock a lock. In an alternative embodiment of the invention a selector assembly which is slideably mounted on the housing supports an operating button which facilitates pressing the desired button to select a key.

8 Claims, 6 Drawing Sheets

KEY CASE WITH KEY SELECT MECHANISM

RELATED APPLICATION

The present application claims priority from my Provisional Patent Application titled "Key Case with Key Select Mechanism," Ser. No. 60/902,704, filed Feb. 21, 2007.

FIELD OF THE INVENTION

The present invention relates generally to the field of apparatus for the storage of keys and more particularly to a key case with a key select mechanism and having rotationally mounted key holders.

BACKGROUND OF THE INVENTION

The field of equipment for the storage of keys includes a broad range of devices including a variety of ring type devices and a variety of wallet type devices in which individual keys are retained in individual holders within a wallet like structure. In each of these prior art devices the user must select the desired key for the individual lock which the user desires to open. This process requires a combination of the ability to visually recognize the proper key and a degree of manual dexterity to manually select the desired key from the balance of the keys being stored. This process results in a degree of difficulty for older persons or persons having either visual difficulty or impairment of eye-hand coordination.

Despite the developments of the prior art there remains a need for a key case which can easily present the desired key in response to the pressing of a button.

OBJECTS AND SUMMARY OF THE INVENTION

The primary object of the present invention is to provide a key case in which a desired key can be selected from a holder responsive to the pressing of a button on the holder.

Another object of the present invention is to provide a key case with a key select mechanism which has a plurality of key holders each rotationally mounted in a housing.

Another object of the present invention is to provide a key case with a key select mechanism which can be used to easily select a desired key from a housing.

Yet another object of the present invention is to provide a key case with a key select mechanism which has a relatively small number of component parts which can be manufactured economically in volume resulting in a relatively low unit cost.

Other objects and advantages of the present invention will be made clear hereinafter.

In accordance with the present invention, there is provided a key case having a housing within which there is a plurality of rotationally mounted key holders. Each key holder is connected to an individual key. A plurality of buttons are mounted on the housing. Pressing on a selected button enables a desired key to swing out of the housing and move into a position wherein it can be used to unlock a lock. In an alternative embodiment of the invention a key selector assembly which has a single button is mounted on the housing. The key selector assembly may be moved to a selected position relative to the housing to select the desired key.

BRIEF DESCRIPTION OF THE DRAWINGS

Other important objects and advantages of the present invention will be apparent from the following detailed description of the invention taken in connection with the accompanying drawings in which.

DESCRIPTION OF THE INVENTION

Figure 1:
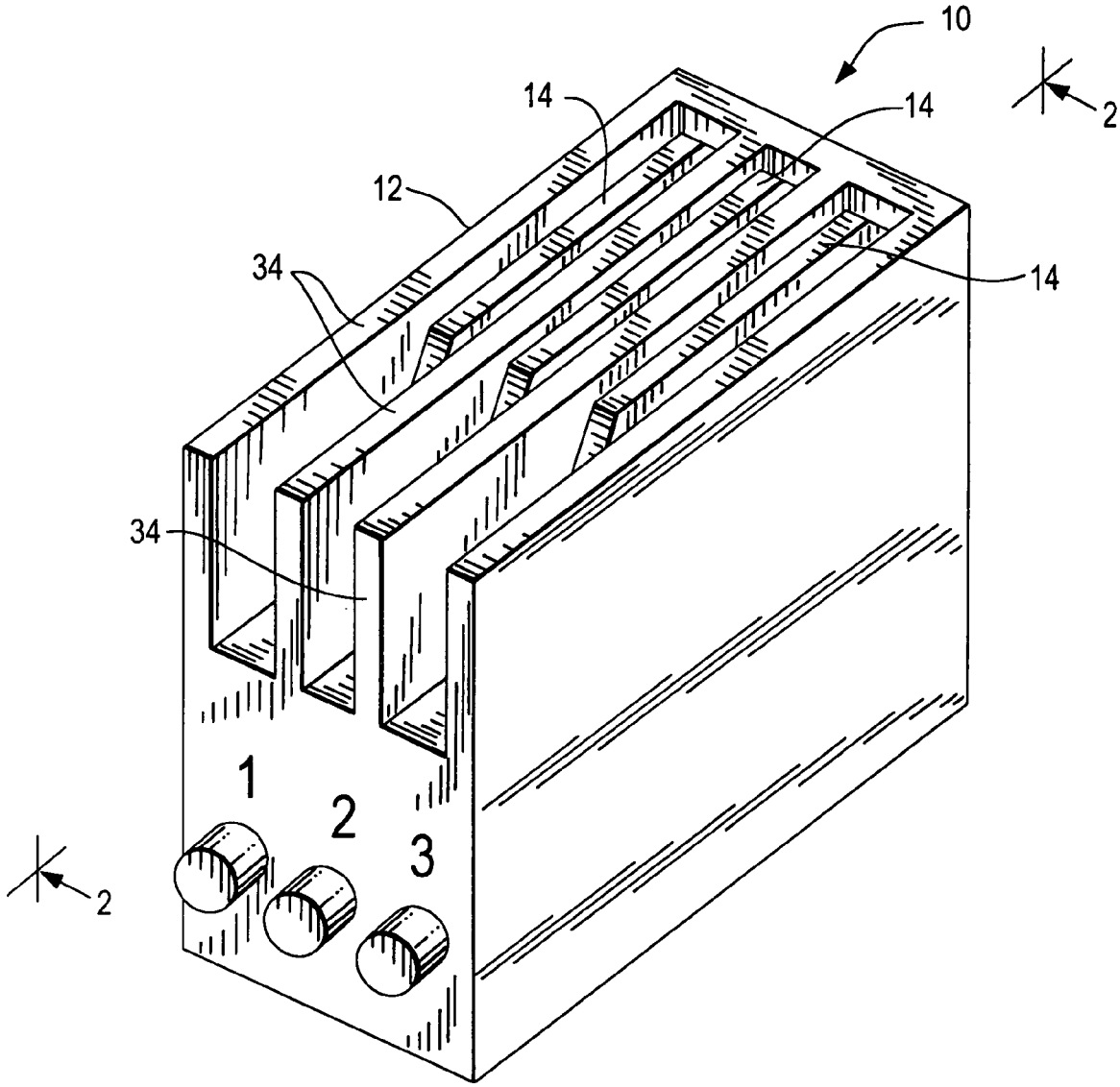
FIG. 1 is an overall perspective view of a key case with a key select mechanism made according to the present invention.

With reference to the drawings, there is shown in FIGS. 1-6 a key case with a key select mechanism 10, in accordance with the present invention, which includes a housing 12 within which there is mounted a plurality of keys 14. The mounting of each of the keys 14 is shown schematically in FIG. 2.

Each key 14 is mounted in a key holder 16 which is pivotally connected to the housing 12 via an axle 18. While the operation of a single key holder 16 will be described in detail it should be understood that this description is by way of example and that the key case 10 according to the present invention may have a single key holder 16 which supports a single key 14 or, more typically, a plurality of key holders 16 thereby accommodating a plurality of keys 14.

The key case 10 includes a flexible operating link or flexible arm 20 which has a first end 22 which is pivotally connected to the key holder 16 via a pin 24. A first portion 26 of the flexible arm 20 is generally curved. A first intermediate portion 28 of the flexible arm 20 has a finger 30 which rides in a curved groove 32 or ramp area formed in a wall 34 of the housing 12. A second portion 36 of the flexible arm 20 has an end 38 which engages the button member 40. The end 42 of the second portion 36 of the flexible arm 20 has an integrally formed pin 44 which engages a socket 46 formed in a first portion 48 of the button member 40.

The button member 40 includes a pressing portion 50 which has a smooth surface 52 adapted for pressing, a first portion 48 connected to the flexible arm 20 and a second portion 52. The second portion 52 is connected to a button latch mechanism which is indicated schematically by a rectangle 54 in FIGS. 2 and 3 and which will be described presently.

Figure 2:
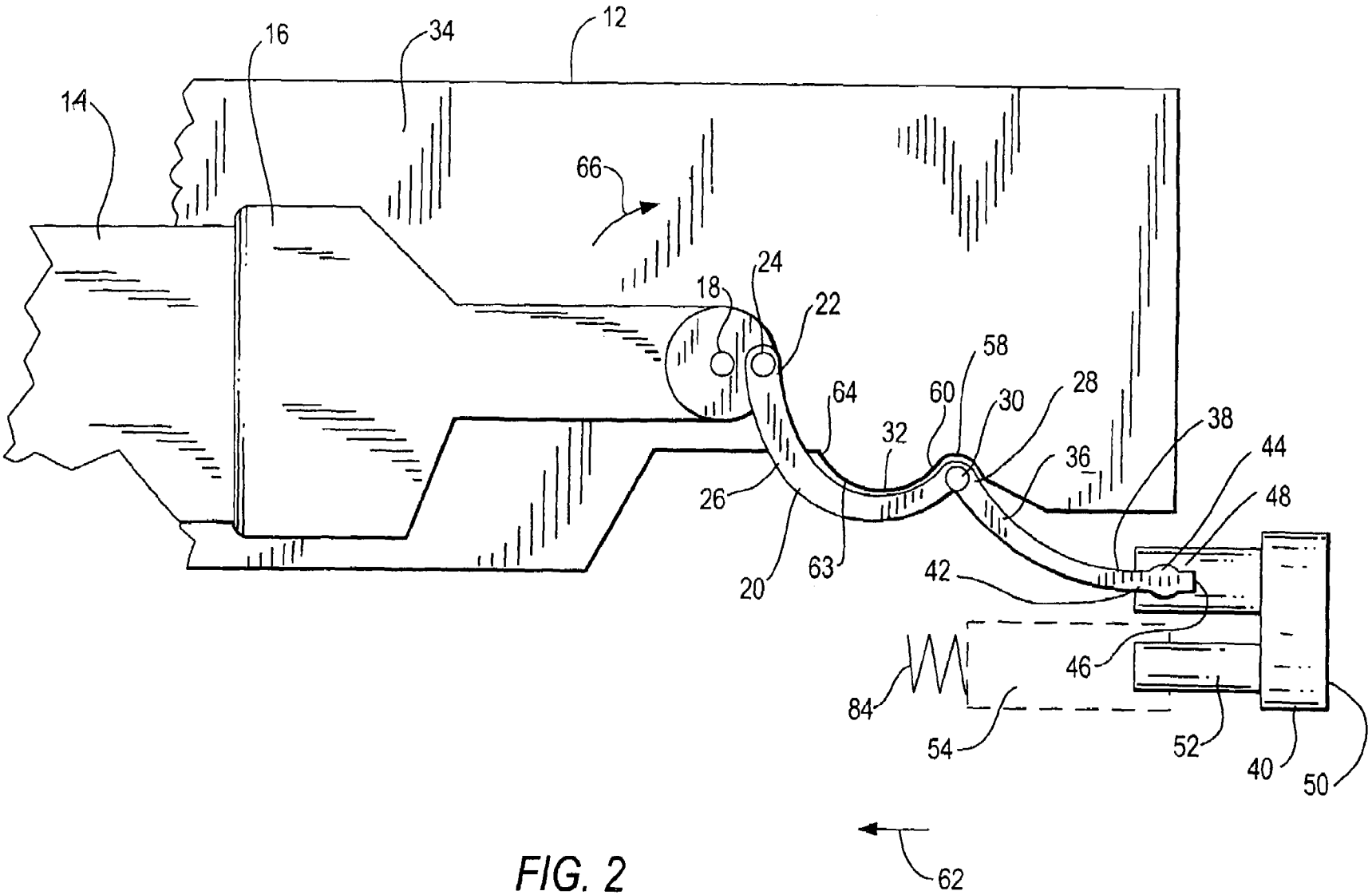
FIG. 2 is a schematic view generally taken along the line 2-2 in FIG. 1 showing the key contained in the housing of the key case.
Figure 3:
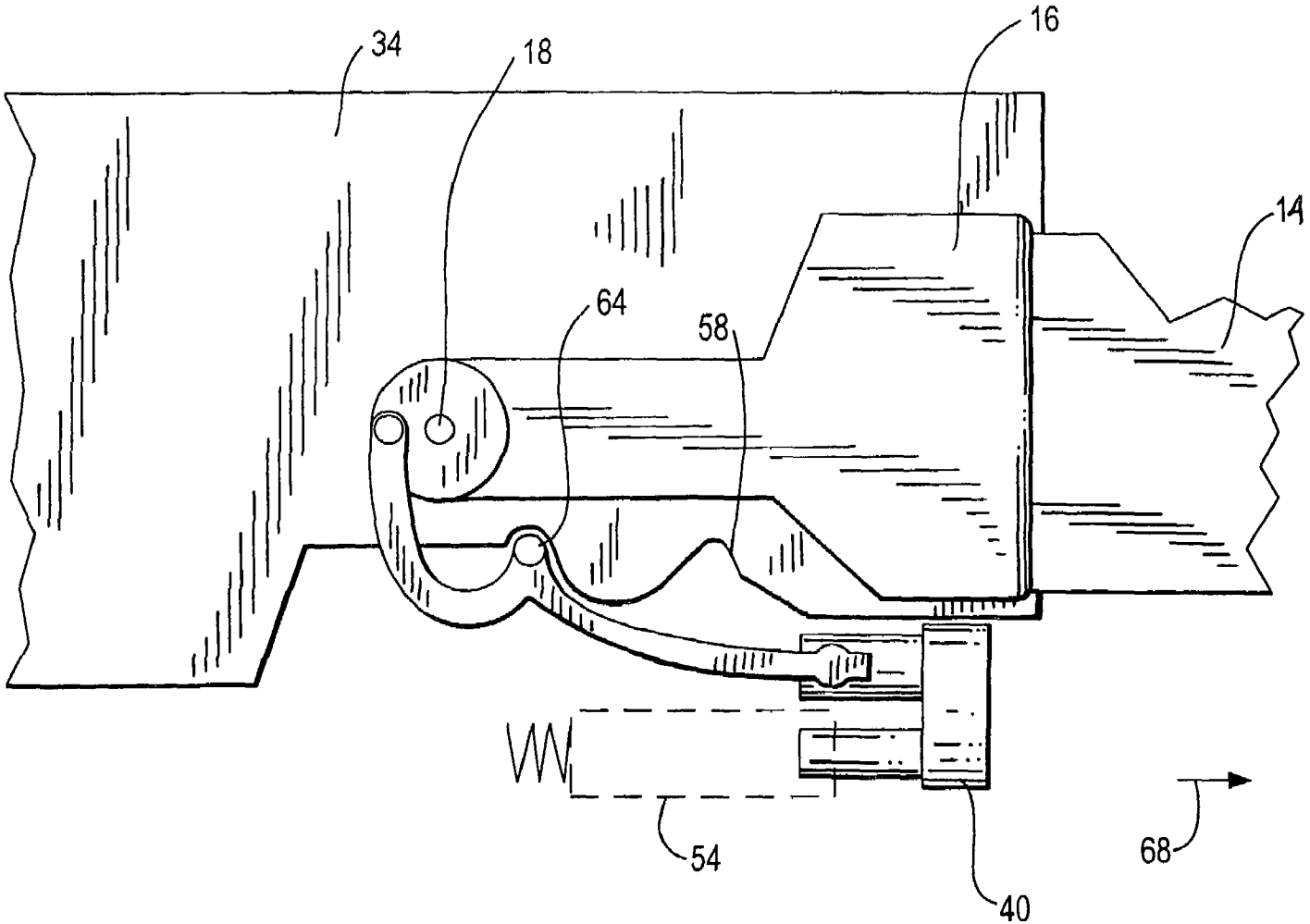
FIG. 3 is a schematic view similar to FIG. 2 showing the key projecting out of the housing of the key case.

FIG. 2 is a schematic view generally taken along the line 2-2 in FIG. 1 showing the relative positions of the various components when the key 14 is contained in the housing 12 of the key case 10. As shown in FIG. 2, when the key 14 is container in the housing 12, the finger portion 30 of the flexible arm 20 rests in a first detent 58 which is formed in the groove portion 60 of the wall 34. When the end 42 of the flexible arm 20 is moved in the direction shown by the arrow 62 in FIG. 2, the finger 30 leaves the first detent 58, and rides in the curved portion 63 of the groove 32 and enters the second detent 64. This action of the flexible arm 20 causes the first end 22 of the flexible arm 20 to rotate the key holder 16 causing the key holder 16 to rotate the key 14 in a direction shown by the arrow 66 in FIG. 2 to a position projecting outwardly relative to the housing 12 as is shown in FIG. 3. The key 14 can now be used to operate a lock. The button member 40 remains depressed as is shown in FIG. 3.

When the button 40 is pressed a second time, the button 40 is released from the latch mechanism 54 and moves in a direction relatively outwardly relative to the housing 12 as shown by the arrow 68 in FIG. 3. This action causes the finger 30 on the flexible arm 20 to return to the first detent 58 and the key holder 16 rotates the key 14 to enter the housing 12 and the position of the various components returns to the position shown in FIG. 2.

Figure 4:
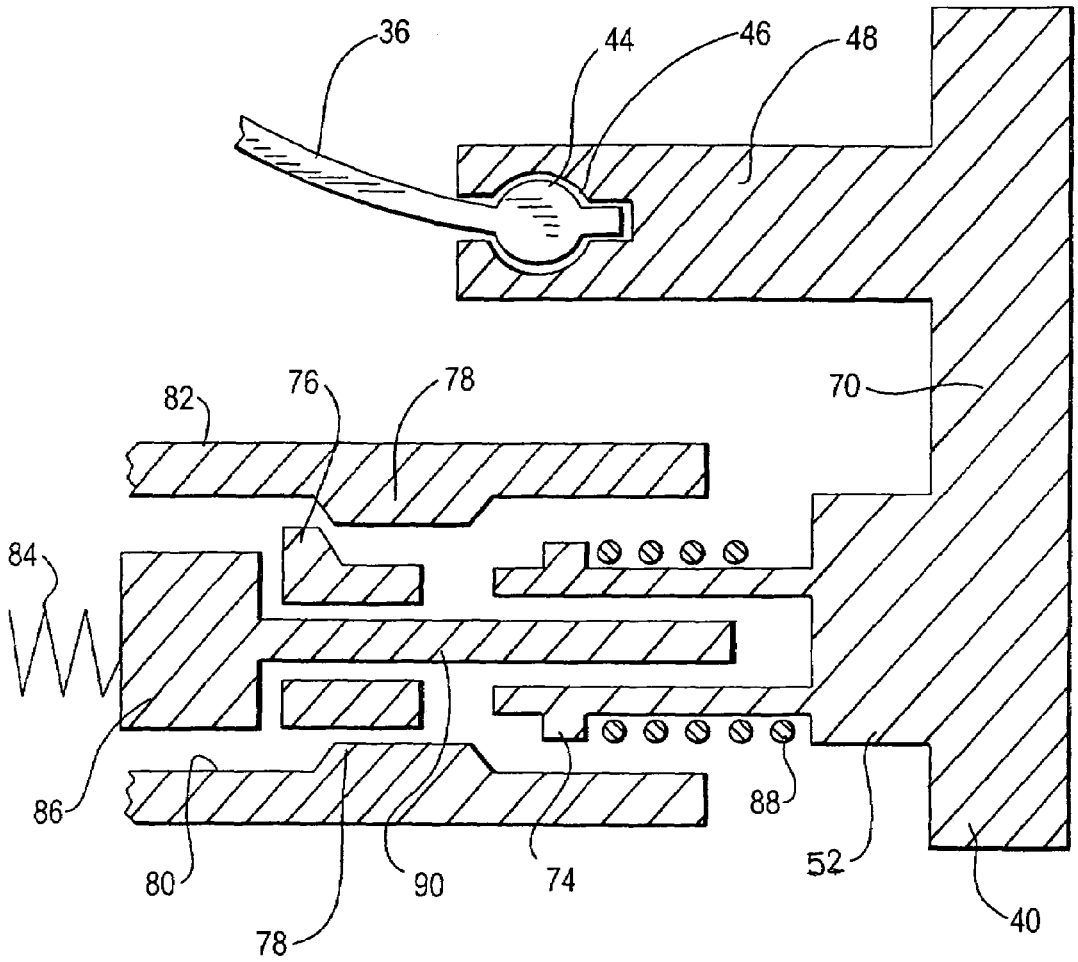
FIG. 4 is a simplified schematic view of the button portion of the key case of FIG. 1.

The components of the button latch mechanism 54 which was indicated as a rectangle 54 in FIGS. 2 and 3 are shown schematically in FIG. 4. The button latch mechanism 54 is conventional in nature and is generally similar to the latch mechanism found on retractable pens and will therefore not be described in detail. The button latch mechanism 54 includes the button member 40 which has a first portion 48 connected to the base 70 and a second portion 52 also connected to the base 70. The second portion 52 has a finger 74 which bears against a rotateably mounted cam member 76 which engages one of a plurality of complementary cam fingers 78 which are formed on the internal surface 80 of a stroke cylinder 82. The finger 74 is spring loaded by spring 88. The pressure of the finger 74 causes the cam member 76 to rotate relative to shaft 90 to lock the button member 40 in the last position. Depressing the button member 40 again rotates the cam member 76 and releases the button member 40 and allows the helical compression spring 84, which bears on member 86 to return the button member 40 to the position shown in FIG. 2.

Figure 5:
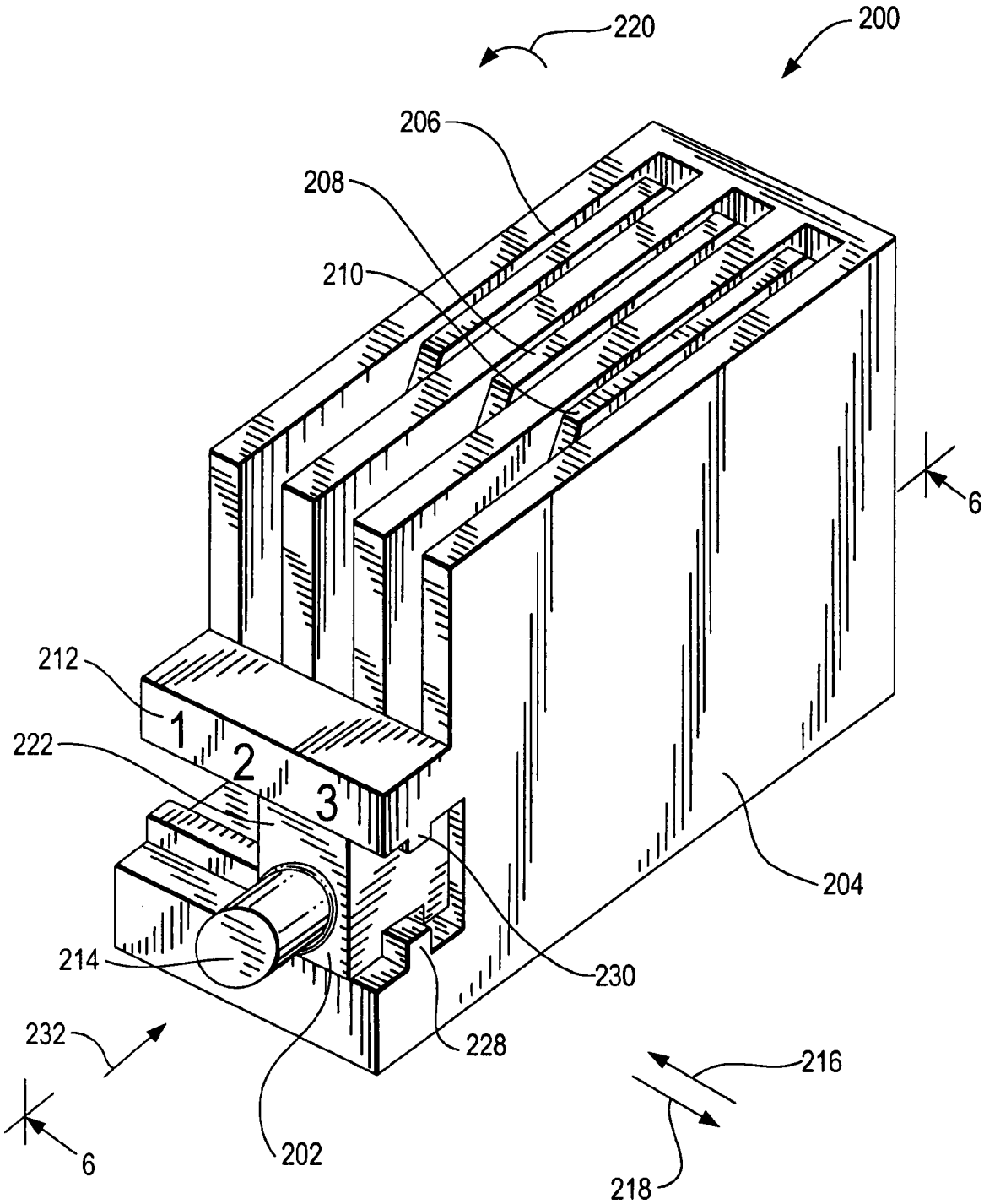
FIG. 5 is an overall perspective view of an alternative embodiment of the key case of FIG. 1 incorporating a sliding key select assembly.
Figure 6:
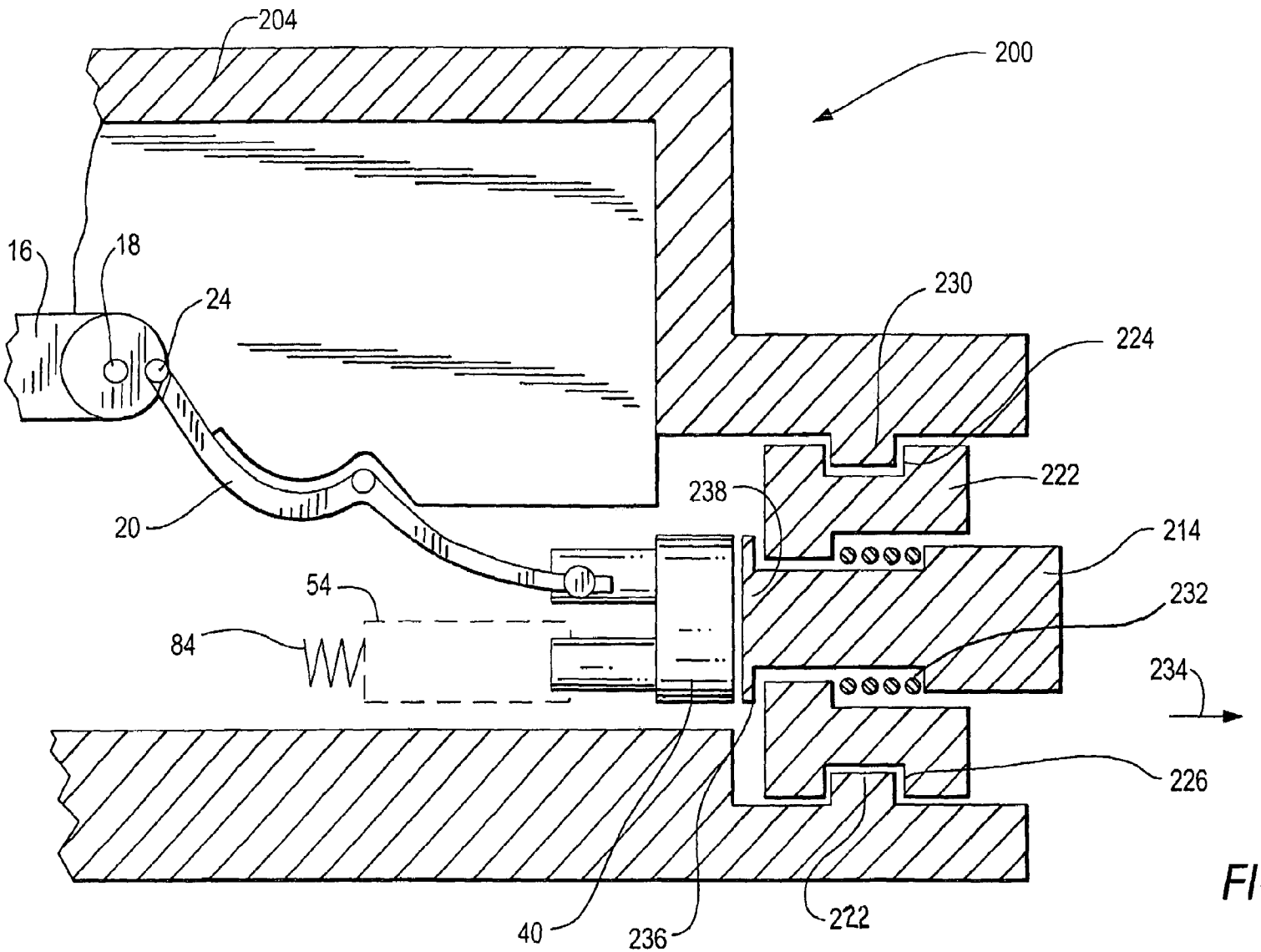
FIG. 6 is a schematic view generally taken along the line 6-6 in FIG. 5 showing the key select assembly.

FIGS. 5 and 6 show an alternative embodiment of the invention 200 which incorporates an external button selector assembly 202 which the user can slide along the housing 204 to select the desired key 206, 208, 210. The housing 204 may have indicia 212 as indicated by the numerals 1, 2, 3 and 4 to aid in selecting the desired key 206, 208, 210. When the external button 214 is moved along the directions shown by the arrows 216, 218 to the desired location which is in alignment with a button member 40, which has been previously described, and which corresponds to the desired key 206, 208, 210 and the external button 202 is depressed by the user, the desired key swings 206, 208, 210 out of the housing 204 in the direction shown by the arrow 220 in the manner previously described and is ready for use.

As shown in FIGS. 5 and 6 the external button selector assembly 202 includes a sliding block 222 which has slots 224, 226 which ride in projections 228, 230 which are formed in the housing 204 and a spring 232 which urges an outer operating button 214 in the direction shown by the arrow 234 in FIG. 6. The outer operating button 214 is retained on the sliding block 222 by the retainer portion 236 which is formed on the end 238 of the outer operating button 214.

The foregoing specific embodiment of the present invention as set forth in the specification herein is for illustrative purposes only. Various deviations and modifications may be made within the spirit and scope of the invention without departing from the main theme thereof.

What is claimed is:

1. A key case comprising:

a housing, with said housing having at least one wall portion with said wall portion having a groove formed thereon;

a key holder;

a pivotal connection with said pivotal connection connecting said key holder and said housing, with said key holder having a first position wherein said key holder projects inwardly relative to said housing and a second position wherein said key holder projects outwardly relative to said housing;

an operating button, with said operating button slideably mounted in said housing;

a spring with said spring mounted in said housing and disposed bearing on said operating button;

a flexible operating link with said flexible operating link having a first end, an intermediate portion and a second end and with said first end of said operating link disposed connected to said key holder, with said intermediate portion having a sliding connection with said groove and with said second end disposed proximate to said operating button and with pressure on said operating button causing pressure on said first end of said flexible operating link and causing said second end of said flexible operating link to reversibly rotate said key holder from said first position to said second position.

2. The key case as claimed in claim 1 wherein said operating link comprises a projecting portion, with said projecting portion disposed riding in said groove.

3. The key case as claimed in claim 1 further comprising:

a latch mechanism with said latch mechanism connected to said operating button and with said latch mechanism latching said operating button in a first position corresponding to said key holder projecting inwardly relative to said housing and a second position corresponding to said key holder projecting outwardly relative to said housing.

4. A key case comprising:

a housing, with said housing having at least one wall portion with said wall portion having a groove formed thereon;

at least one key holder;

at least one pivotal connection with said pivotal connection connecting said key holder and said housing with said key holder having a first position wherein said key holder projects inwardly relative to said housing and a second position wherein said key holder projects outwardly relative to said housing;

at least one operating button, with said operating button slideably mounted in said housing;

at least one spring mounted in said housing and disposed bearing on said operating button;

at least one flexible operating link with said flexible operating link having a first end, an intermediate portion and a second end and with said first end of said operating link disposed connected to said key holder, with said intermediate portion having a sliding connection with said groove and with said second end disposed proximate to said operating button and with pressure on said operating button causing pressure on said first end of said flexible operating link and causing said second end of said flexible operating link to reversibly rotate said key holder from said first position to said second position.

5. A key case comprising:

a housing, with said housing having a plurality of wall portions with said wall portions each having a groove formed thereon;

a plurality of key holders;

a plurality of pivotal connections with said pivotal connections connecting said key holders and said housing with said key holders having a first position wherein said key holders project inwardly relative to said housing and a second position wherein said key holders projects outwardly relative to said housing;

a plurality of operating buttons, with said operating buttons slideably mounted in said housing;

a plurality of springs with said springs mounted in said housing and disposed bearing, one each, on said operating buttons;

a plurality of operating links with said operating links each having a first end, an intermediate portion and a second end and with first end of said operating links disposed connected to one of said key holders, with each of said intermediate portion having a sliding connection with one of said grooves and with said second end disposed proximate to one of said operating buttons and with pressure on a selected operating button causing pressure on said first end of said operating link and causing said second end of said operating link to reversibly rotate said key holder from said first portion to said second position; and further comprising a key selector assembly, with said key selector assembly comprising a selector block slideably mounted on said housing and disposed proximate to said plurality of operating buttons for selectively bearing on a selected operating button.

6. The key case as claimed in claim 5 comprising an outer operating button, with said outer operating button mounted on said selector block.

7. A key case comprising:

a housing, with said housing having at least one wall portion with said wall portion having a cam groove formed thereon;

a key holder;

a pivotal connection with said pivotal connection connecting said key holder and said housing, with said key holder having a first position wherein said key holder projects inwardly relative to said housing and a second position wherein said key holder projects outwardly relative to said housing;

an operating button, with said operating button slideably mounted in said housing;

a spring with said spring mounted in said housing and disposed bearing on said operating button;

an operating link with said operating link having a first end, an intermediate portion and a second end and with said first end of said operating link disposed connected to said key holder, with said intermediate portion having a sliding connection with said cam groove and with said second end disposed proximate to said operating button and with pressure on said operating button causing pressure on said first end of said operating link and causing said second end of said operating link to reversibly rotate said key holder from said first position to said second position.

8. A key case comprising:

a housing, with said housing having at least one wall portion with said wall portion having a cam groove formed thereon;

at least one key holder;

at least one pivotal connection with said pivotal connection connecting said key holder and said housing with said key holder having a first position wherein said key holder projects inwardly relative to said housing and a second position wherein said key holder projects outwardly relative to said housing;

at least one operating button, with said operating button slideably mounted in said housing;

at least one spring mounted in said housing and disposed bearing on said operating button;

at least one operating link with said operating link having a first end, an intermediate portion and a second end and with said first end of said operating link disposed connected to said key holder, with said intermediate portion having a sliding connection with said cam groove and with said second end disposed proximate to said operating button and with pressure on said operating button causing pressure on said first end of said operating link and causing said second end of said operating link to reversibly rotate said key holder from said first position to said second position.

* * * * *